United States Patent [19]

Mascia

[11] Patent Number: 4,905,338

[45] Date of Patent: Mar. 6, 1990

[54] SKI WAX SCRAPER

[76] Inventor: Michael B. Mascia, 103 S. High St., Bridgton, Me. 04009

[21] Appl. No.: 227,110

[22] Filed: Aug. 2, 1988

[51] Int. Cl.[4] ..... A63C 11/00; A63C 11/08

[52] U.S. Cl. ..... 15/236.05; 15/236.01; 15/236.07; 280/809

[58] Field of Search ..... 15/236.01, 236.05, 236.06, 15/236.07, 236.08, 236.09; 30/169, 172; 280/809, 813

[56] References Cited

U.S. PATENT DOCUMENTS 3,154,352 10/1964 Riffelmacher et al. ..... 15/236.05 X
3,643,328 2/1972 Wainwright, Jr. ..... 15/236.06 X
3,990,147 11/1976 Gill et al. ..... 30/172

FOREIGN PATENT DOCUMENTS 211204 9/1960 Austria ..... 15/236.01

*Primary Examiner*—Edward L. Roberts

*Attorney, Agent, or Firm*—Nutter, McClennen & Fish

[57] ABSTRACT

A scraper for removing wax from the base of a ski includes an elongated rigid tubular member and a flat rigid generally rectangular blade projecting from the side of the tubular member between the ends thereof. The blade has a pair of parallel scraping edges extending at right angles from the tubular member at locations spaced from the opposite ends thereof. When the scraper is positioned with one of its scraping edges crosswise on a ski base and with the adjacent end of the tubular member engaging the edge of the ski, the tubular member can functioin as both a handle and a guide member for guiding the scraper along the ski. Bluntly pointed end caps are mounted to the opposite ends of the tubular member which are contoured to fit snugly in a ski base guide groove. When one of the end caps is engaged and moved along the guide groove, it effectively scrapes wax from the groove without injuring the groove or the ski base generally.

11 Claims, 1 Drawing Sheet

SKI WAX SCRAPER

This invention relates to a scraper for scraping wax from the running surface or base of a ski. It relates more particularly to a hand held scraper which is especially suited for removing hot melt or so called glide wax from the base of a snow ski.

BACKGROUND OF THE INVENTION

As is well known, various types of waxes are often applied to the base of a ski to condition its sliding surface to different snow conditions. A wax of the hot melt type is commonly used for this purpose to improve the gliding properties of the ski. The wax is applied to the ski base as a relatively hot liquid. Upon cooling, the wax sets and adheres to the ski base forming a relatively hard surface layer that covers the entire base area, including the longitudinal guide groove usually present therein.

However, as initially applied, the wax layer is usually too thick and uneven for a superior glide, and accordingly some wax removal is usually necessary to provide a thin, smooth sliding surface along the entire length of the ski and to clean out the guide groove. In other words, an optimal glide is produced by providing a very thin smooth layer of wax on the ski base. Also, after infrequent use of the ski, rewaxing may occur because of localized damage to the wax layer caused by the ski sliding over rocks, roots or other hard objects. As a rule, however, it is not desirable to make localized repairs to the wax layer by applying fresh hot wax to selected spots on the ski base. Rather, the preferred practice is to apply a fresh layer of wax to the entire base of the ski. Also, to avoid excessive wax build-up, it is sometimes preferable to remove the old wax layer before a new one is applied.

Wax is usually removed from a ski base by means of a handheld blade-type scraper. Often the scraper is simply a generally rectangular metal or plastic plate having on or more relatively sharp edges. The skier scrapes away the wax by placing the edge of the plate crosswise on the ski base and sliding the plate along the ski while tilting the plate in the opposite direction.

Prior hand-held tools of this general type are disadvantaged in that there are no means other than the skier's hand for guiding the scraper along the ski. Consequently, the scraper blade tends to wander laterally as it is pushed along the ski base. Resultantly, the removal of the wax coating i not uniform over the surface of the ski base so that an irregular sliding surface is presented to the snow, and the ski does not glide as well as might be desired. Additionally, the prior blade type scrapers are difficult to hold and manipulate for maximum effect.

Another disadvantage of conventional scrapers is that they are not specifically designed to effectively remove wax from a guide groove in the ski base. Some skiers use a corner of the scraper blade to scrape wax from the guide groove. However, if that blade has sharp corners it tends to score the bottom or sides of the guide groove. On the other hand, if the blade has rounded corners and so does not score the ski, the blade still does not remove wax effectively from the guide groove because the blade corners do not normally have the same shape as the groove cross section or profile. Also, the moving blade can slip out of the groove and scratch or gouge the base of the ski. Bear in mind too that the cross sectional dimensions and shape of the guide groove are not the same for all skis. Therefore, if a particular scraper is effective in removing wax from the guide groove of one ski, that does not necessarily mean that it will be so for other skis and unless all of the old wax is removed from the guide groove, wax there will be at least some degradation extent the gliding properties of the ski.

SUMMARY OF THE INVENTION

Accordingly it is an object of the present invention to provide a ski wax scraper which is particularly effective in removing hot melt wax from the base of the ski.

Another object of the invention is to provide a scraper of this type which is easy to use.

Another objection to provide a ski wax scraper which can be sharpened easily giving it a relatively long useful life.

A further object of the invention is to provide a ski wax scraper which helps to guide the scraping action to achieve uniform removal of wax from the ski base.

A further object of the invention is to provide such a scraper which can remove wax completely from the longitudinal guide groove in the ski base without scratching or marring the ski base.

Yet another object of the invention is to provide a scraper of this type which can remove wax effectively from such guide grooves having different profiles or cross-sections.

Still another object of the invention is to provide a ski wax scraper which helps to contain wax debris scraped from a ski base groove.

A further object of the invention is to provide a ski wax scraper which is relatively easy and inexpensive to make.

Other objects will, in part, be obvious and will, in part, appear hereinafter.

The invention accordingly comprises the features of construction, combination of elements and arrangement of parts which will be exemplified in the following detailed description, and the scope of the invention will be indicated in the claims.

Briefly, my scraper comprises a generally rectangular blade or plate whose length is somewhat greater than the width of a typical alpine ski and whose width is wider than a typical cross country ski. Mounted to one of the long edges of the blade is a tube that extends parallel to that edge. The tube has a relatively small diameter and it is longer than the blade so that opposite end segments of the tube extend appreciably beyond the opposite ends of the blade. This tube functions as a handle to enable one to hold and manipulate the scraper. Also, as will become apparent, the tube helps to guide the scraper when that is being used.

The remaining long edge of the blade is sharpened, preferably by squaring off that blade edge to form two scraping edges one at each side of the blade. A skier holding the scraper by way of its tubular handle can position that long edge crosswise against the ski base and move the scraper along the length of the ski base in a smooth continuous motion to achieve uniform removal of the wax thereon.

The shorter edges of the blade are also sharpened in the same manner to form additional scraping edges. Using the tube-like handle, the skier can position one of these shorter edges crosswise against the ski base so that the adjacent projecting end of the tube engages the edge of the ski. Then, by pushing the scraper along the ski base and simultaneously pressing the tube against the edge of the ski, the scraper is caused to follow a straight, rather than a wandering, path along the length of the ski. This straight scraping motion encourages or promotes uniform removal of wax from the entire ski base area.

In addition to functioning as a handle and as a guide member, the tube also assists in the removal of wax from the longitudinal guide groove usually present in the base of a ski. More particularly, there is removably mounted in the opposite ends of the tube a pair of generally frustoconical plugs or caps. Each cap tapers to a rounded or blunt tip which is dimensioned to fit in one of the more prevalent size ski base grooves. Preferably, the tips of the two caps are dimensioned to fit in different size grooves. Furthermore, each cap is hollow and a hole is present at the tip of the cap. When the user holds the scraper so that one of the cap tips is engaged in a ski base groove, and slides that tips along the groove, the edge of the hole thereat will scrape wax from the groove in a thorough and uniform manner.

Additionally, the removed wax will enter the hole in the tip of the cap and slide up inside the cap and tube instead of simply being pushed out of the groove and onto the floor. Since the tip of the engaging cap is contoured to fit the groove, it does not tend to slip out of the groove. The removed wax also helps to keep the cap in the groove because it forms a more or less continuous string that extends up inside the cap. Needless to say, then, using my scraper there is less wax debris to clean up after the scraping job is completed.

Using this simple tool, wax and especially hot melt wax can be removed from the base of a ski quite evenly and uniformly in a minimum amount of time so that the base will present a smooth, even sliding surface to the snow. Yet the scraper, which can be a unitary molded plastic part, can be manufactured in quantity relatively easily and economically.

BRIEF DESCRIPTION OF THE DRAWING

For further understanding of the nature and the objects of the invention, reference should be had to the following detailed description, taking in connection with the accompanying drawing, in which.

DESCRIPTION OF THE PREFERRED EMBODIMENT

Figure 1:
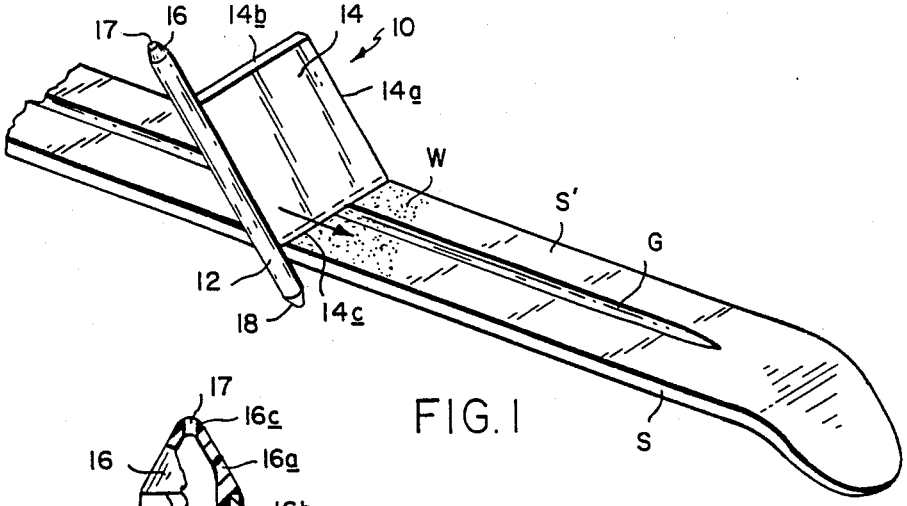
FIG. 1 is a fragmentary isometric view showing a ski wax scraper incorporating my invention as it removes wax from a ski.

FIG. 1 of the drawing shows my scraper 10 positioned on the running surface or base S′ of a ski S. The ski base S′ has a single guide groove G extending along the longitudinal axis of base S′. Typically, the groove extends substantially the entire length of the ski except for the upturned head segment thereof. The width of base S′ is usually in the range of 2.5 to 5.0 inches and the guide groove G is more or less semicircular with a diameter in the order of 0.25 to 0.50 inch.

Figure 2:
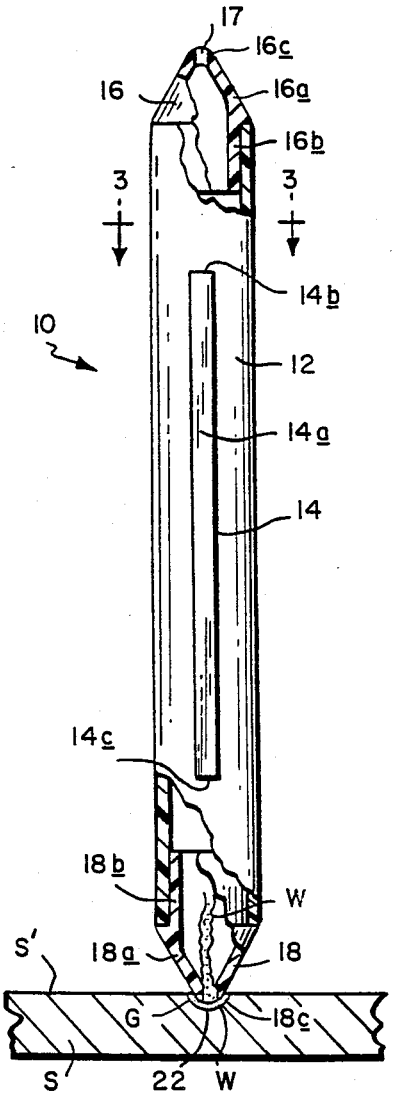
FIG. 2 is an elevational view on a larger scale, with parts broken away, showing certain elements of FIG. 1 scraper in greater detail.

As shown in FIGS. 1 and 2, scraper 10 includes a rigid handle tube 12 and a rigid flat plate or blade 14 extending laterally from the side of the tube. Blade 14 is generally rectangular with one long edge of the blade fixed to the tube. As shown in the drawing figures, tube 12 is longer than blade 14 so that the ends of the tube project beyond the opposite ends of the blade. The remaining long edge **14*a* of blade 14** is squared off or sharpened to form a pair of long scraping corners or edges, at opposite sides of the blade so that either side of the blade may face the ski when scraping with that blade edge.

The two shorter blade edges **14*b* and 14*c* are also sharpened in the same fashion to form a pair of scraping edges along each of those shorter blade edges. The width of the blade 14, i.e. the lengths of its edges 14*b* and 14*c*, is such that when one of those edges, e.g. edge 14*b* is positioned crosswise on the ski base as shown in FIG. 1 with the adjacent projecting end of tube 12 engaging the edge of the ski, the blade edge 14*b*** will extend across the entire width of the ski base.

Figure 3:
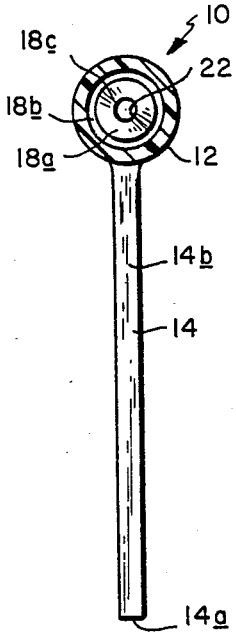
FIG. 3 is a sectional view taken along line 3—3 of FIG. 2.

Referring now to FIG. 2 and 3, a pair of hollow end caps or plugs 16 and 18 are removably mounted to the opposite ends of tube 12. Cap 16 has a generally frustoconical exterior section **16*a* whose maximum diameter is more or less the same as the outside diameter of tube 12. Projecting from the large end of plug section 16*a* is a skirt or flange 16*b* whose outside diameter is more or less the same as the inside diameter of tube 12. Consequently, skirt 16 can be received in the end of the tube with a snug fit that suffices to retain the cap on the end of the tube as shown. If desired, skirt 16*b* and the inside wall of tube 12 may be provided with interfitting ribs and grooves to provide a more positive attachment of the cap to the tube. Cap 16 tapers to a rounded or blunt tip or end 16*c* that has more or less the same size and shape as the guide groove G in ski base S′. Also, a hole 17 is provided at the cap tip 16*c* that opens into the cap and the end of tube 12**.

Cap 18 is similar to cap 16 in that it has a generally frustoconical or tapered section **18*a* and a smaller diameter skirt 18*b* which fits snugly, but removably, in the opposite end of tube 12. Cap 18 is also hollow and it is provided with a commensurately sized hole 22 at the cap tip 18*c* which opens into the interior of tube 12. The only real difference between the two caps is that their tips 16*c* and 18*c* have different diameters or contours to enable them to more closely fit different ones of the more prevalent guide groove sizes. However, they may also have different size holes 17, 22. Also, if desired, additional caps with tips of different shapes and sized may be provided for scraper 10** to fit the guide grooves of most other skies.

Tube 12 and plate 14 can be formed as a unitary molded plastic part with the blade edges squared off in the molding process. Likewise, the end caps 16 and 18 can be molded of the same material. Alternatively, the blade can be made of metal and fastened to a metal or plastic tube by any suitable means, with the plate edges being sharpened as described by any conventional means. In this event, the caps 16 and 18 would also be made of metal or plastic.

To remove wax W from the ski base S′ using scraper 10, one of the shorter blade edges, say edge **14*c*, may be positioned crosswise on the ski base as shown in FIG. 1 so that the adjacent end of tube 12 engages and extends down beyond the edge of the ski as shown in that figure. Next, using tube 12 as a handle, the scraper is tilted back to place the adjacent corner of blade edge 14*c* against the ski base S′. Then, the scraper is moved along the base in the direction of the arrow shown in FIG. 1 while simultaneously a lateral force is applied that presses tube 12** against the edge of the ski so that in its lengthwise sliding motion, the scraper will be constrained to follow a straight line along the ski. This assures that the removal of the wax W by the scraper will be thorough uniform and even along the entire length of the ski. There will be no tendency for the tool to follow a wandering or wavy path along the ski which, as discussed above, tends to produce a non-uniform and less thorough scraping action.

If that edge 14c corner becomes so rounded, dull or nicked that it no longer properly performs it scraping function, the user can turn the scraper over so that the opposite corner of that same edge contacts the ski base and so that tube 12 engages the opposite side edge of the ski and continues the scrapping action. Alternating, the user can place the opposite blade edge 14b against the ski base and resume the scraping process with each corner of that edge. In that event, the engagement of the ski edge by the other projecting segment of tube 12, will assure that uniform linear scraping action will result with that blade edge. It is noteworthy in this connection that because the edges 14a, 14b and 14c sharpened in a squared-off manner, each blade edge has two corners which the skier may use as the scraping edge. Since all f the blade edges have squared off scraping edges on corners, each blade edge can be sharpened quickly and easily if grinding the blade edges in a flat or squared-off manner.

Instead of using the shorter blade edges 14b and 14c, the skier may, of course, position the long blade edge 14a against the ski base, holding the scraper by the opposite projecting ends of tube 12 and push the scraper along the ski with one corner of the blade in contact with the ski base, as one might use a spokeshave, to remove the excess wax.

Referring now to FIG. 2, in order to use the scraper 10 to remove wax from the guide groove G, the cap tip 16c, 18c that most closely fits the groove G in the particular ski is engaged in the groove as shown, and the tube is angled back somewhat, as in FIG. 1. This causes the rearward segment of the edge of the hole in the end cap to bear against the wall of the groove so that that edge segment forms a curved cutting or scraping edge that conforms more or less to the curvature of the guide groove. The tube is then moved along the ski so that the cap tip and the edge of the hole in that tip scrape along the groove. Since the cap tip engaging in the groove, e.g tip 18c, more or less conforms to the contour of the groove, the removal of wax from each lengthwise groove increment will be thorough and uniform across the entire groove cross-section and there will be no scoring or other damage to the groove wall.

During the scraping process, wax W removed from the groove G will enter the hole at the engaging cap end, e.g. hole 22, and slide up into the cap and tube as a continuous string or shaving as shown in FIG. 2. Since the cap end fits the groove relatively closely, the cap does not tend to slip out of the groove. Moreover, the wax string or shaving extending through opening 22 into the cap helps to hold the cap in the groove. Accordingly there is little likelihood of the cap jumping out of the groove and scoring, gouging, or otherwise damaging the flat surface of the ski base S'. Also, since the wax debris removed from the guide groove G is contained within the scraper tube 12, it means that there is less debris to clean up after the ski base S' has been completely conditioned. Of course, the tube can be emptied of wax by removing one or both of the end caps 16, 18, and pouring, or if necessary pushing the wax out of the tube.

The ski wax scraper described herein is a relatively compact tool that can be carried about in a pocket so that it is available when needed. The tool can be made relatively inexpensively of rugged metal or plastic material using conventional manufacturing techniques, and, since it has no moving parts and can be sharpened easily, it should have a relatively long useful life.

It will thus be seen that the objects set forth above, among those made apparent from the preceding description, are efficiently attained and, since certain changes may be made in the above construction without departing from the scope of the invention, it is intended that all matter contained in the above description or shown in the accompanying drawing shall be interpreted as illustrative and not in a limiting sense.

It will also be understood that the following claims are intended to cover all of the specific features of the invention herein described.

I claim:

1. A scraper for scraping wax from a ski base of the type having a longitudinal guide groove, said scraper comprising a flat rigid blade having at least one straight scraping edge, an elongated rigid member mounted to said blade and extending in a direction generally perpendicular to said edge, said member having an end segment extending beyond and overhanging said edge to enable said member to function both as a handle and as a guide for guiding the blade along said ski base and an end cap mounted to an end of said member, said end cap having a relatively small diameter tip that is contoured to fit in and scrape said guide groove.

2. The scraper defined in claim 1 wherein said end cap is hollow, and further including means defining a hole in said end cap tip.

3. The scraper defined in claim 2 and further including a second similar end cap mounted to the opposite end of said member, said end caps having differently sized or shaped contoured tips.

4. The scraper defined in claim 3 wherein said member is tubular and said end caps are removably mounted to opposite ends of said member.

5. The scraper defined in claim 1 wherein said blade is generally rectangular and has a second scraping edge located directly opposite and parallel to said scraping edge, and said elongated rigid member has an opposite end segment extending beyond and overhanging said second scraping edge.

6. The scraper defined in the claim 5 wherein said member is mounted to a long edge of said blade and the opposite long edge of said blade is sharpened to form a third scraping edge.

7. The scraper defined in claim 6 wherein said scraping edge and said second scraping edge are squared off to form a pair of scraping corners at opposite sides of said blade.

8. A scraper for scraping wax from a ski base of the type having a longitudinal guide groove, said scraper comprising an elongated rigid member, a first hollow end cap removably mounted to one end of said member, said first end cap having a smoothly rounded generally pointed tip and a hole through the tip into the first end cap, a second hollow end cap removably mounted to the opposite end of said member, said second end cap having a smoothly rounded generally pointed tip and a hole through said tip into said second end cap and a flat rigid blade extending from one side of said member, said blade having a first scraping edge extending substantially at a right angle from said member at a location spaced from one end thereof.

9. The scraper defined in claim 8 wherein said blade has a second scraping edge extending substantially at a right angle from said member at a location spaced from the opposite end thereof.

10. The scraper defined in claim 9 wherein said blade has a third scraping edge extending parallel to said member between said first and second scraping edges.

11. The scraper defined in claim 10 wherein said first and second scraping edges one are each squared off to form a pair of scraping corners at opposite sides of said blade.

* * * * *